US011051091B2

(12) United States Patent
Ivey

(10) Patent No.: US 11,051,091 B2
(45) Date of Patent: Jun. 29, 2021

(54) CLEANROOM SMALL CEILING SPEAKER SYSTEM

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 232 days.

(21) Appl. No.: 16/135,190

(22) Filed: Sep. 19, 2018

(65) Prior Publication Data

US 2019/0090039 A1 Mar. 21, 2019

Related U.S. Application Data

(63) Continuation-in-part of application No. 16/129,175, filed on Sep. 12, 2018, which is a continuation-in-part of application No. 15/710,654, filed on Sep. 20, 2017, now Pat. No. 10,237,636.

(51) Int. Cl.
*H04R 1/02* (2006.01)
*H04R 1/34* (2006.01)
*H04R 1/32* (2006.01)

(52) U.S. Cl.
CPC ..... *H04R 1/023* (2013.01); *H04R 1/025* (2013.01); *H04R 1/026* (2013.01); *H04R 1/323* (2013.01); *H04R 1/345* (2013.01); *H04R 2201/021* (2013.01); *H04R 2201/029* (2013.01)

(58) Field of Classification Search
CPC ..... H04R 1/023; H04R 1/025; H04R 1/026; H04R 1/323; H04R 1/345; H04R 2201/021; H04R 2201/029
USPC ..... 381/87, 332, 152, 160, 386, 391, 189; 181/150, 155
See application file for complete search history.

(56) References Cited

U.S. PATENT DOCUMENTS 7,324,656 B2 * 1/2008 Iwayama ..... H04R 1/345 381/189
8,913,776 B2 * 12/2014 Maezawa ..... H04R 1/345 381/386
D781,818 S 3/2017 Pera et al.
2005/0008173 A1 * 1/2005 Suzuki ..... H04R 1/345 381/160
2005/0271244 A1 12/2005 Kobayashi et al.
2005/0281429 A1 * 12/2005 Rivera ..... H04R 1/023 381/391

(Continued)

*Primary Examiner* — Huyen D Le

(74) *Attorney, Agent, or Firm* — Keith L. Jenkins, Registered Patent Attorney, LLC; Keith L. Jenkins

(57) ABSTRACT

A cleanroom compatible elastomeric cover for an acoustic attachment, such as a diffuser or a director, to a Small Ceiling Speaker System. The present invention provides one elastomeric cover for the otherwise exposed axial acoustic port of a director or the exposed radial acoustic port of a diffuser. The cover further provides a cleanroom seal between the diffuser or the director and the ceiling tile. The diffuser and the director are each acoustic attachments to the enclosed speaker portion of the small ceiling speaker that is above the ceiling tile and supported on the ceiling tile support grid, rather than the tile itself. The portion of the small ceiling speaker that is below the ceiling tile includes a sectionally threaded acoustic channel shell and an acoustic attachment. The cover prevents contaminants from entering the cleanroom though the hole in the ceiling tile through which the acoustic channel shell extends.

20 Claims, 6 Drawing Sheets

(56) References Cited

U.S. PATENT DOCUMENTS

| | | | | |
|---|---|---|---|---|
| 2011/0019862 | A1* | 1/2011 | Smith | H04R 1/26<br>381/386 |
| 2014/0138181 | A1 | 5/2014 | Mori | |

* cited by examiner

CLEANROOM SMALL CEILING SPEAKER SYSTEM

RELATIONSHIP TO OTHER APPLICATIONS

The present application is a continuation-in-part of U.S. patent application Ser. No. 16/129,175 filed Sep. 12, 2018 by the same inventor which is a continuation in part of U.S. patent application Ser. No. 15/710,654 filed Sep. 20, 2017 by the same inventor.

FIELD OF ART

The present invention relates to ceiling mounted loudspeakers having a small form factor and direct sound delivery. The present invention more particularly relates to a small speaker system with a cover that can adjust over a range of thicknesses of ceiling tiles and can be used with the director of applicant's Direct Fire Small Ceiling Speaker System of U.S. patent application Ser. No. 16/129,175 and with the diffuser of applicant's Small Ceiling Speaker System of U.S. patent application Ser. No. 15/710,654.

BACKGROUND OF THE INVENTION

Ceiling speakers are used in suspended ceilings, typically for public address, alarm, or musical entertainment purposes. Many ceiling speakers are designed for predetermined thicknesses of ceiling tile. Many ceiling speakers also load the ceiling tile which can cause deformation or failure of the tile over time. Direct fire speakers provide a small audio footprint and are useful in sound masking applications. Diffusion speakers provide a large audio footprint and are useful in public address systems. Speakers used in cleanrooms must not admit contaminates into the clean room.

SUMMARY OF THE INVENTION

Briefly described, the invention includes a specially configures elastomeric cover for applicant's previously filed Direct Fire Small Ceiling Speaker System disclosed in applicant's U.S. patent application Ser. No. 16/129,175 and for applicant's previously filed Small Ceiling Speaker System disclosed in U.S. patent application Ser. No. 15/710,654. The Direct Fire Small Ceiling Speaker System provides direct downward projection of sound ("direct fire") from a small ceiling speaker with a variable adjustable length sound director that is adjustable over a range of ceiling tile thicknesses and has an acoustic port of predetermined size. The Small Ceiling Speaker System provides diffused sound from a small ceiling speaker with a variable adjustable length sound director that is adjustable over a range of ceiling tile thicknesses and has an adjustable acoustic port. The present invention provides one elastomeric cover for the otherwise exposed acoustic port of the director or for the otherwise exposed acoustic port of the diffuser. The cover further provides a cleanroom seal between the diffuser or the director and the ceiling tile. The diffuser and the director are each an acoustic attachment to the enclosed speaker portion of the small ceiling speaker that is above the ceiling tile. The portion of the small ceiling speaker that extends below the ceiling tile includes an acoustic channel shell and an acoustic attachment. The director includes a sectionally threaded cylindrical shell body for adjustably coupling to the acoustic channel shell of the Small Ceiling Speaker System of U.S. patent application Ser. No. 15/710,654, a direct fire ring, a magnetically attachable and releasable grill, and appropriate couplings. The diffuser includes the same sectionally threaded cylindrical shell body for adjustably coupling to the acoustic channel shell of the Small Ceiling Speaker System of U.S. patent application Ser. No. 15/710,654, a diffuser element, and appropriate couplings.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 6:
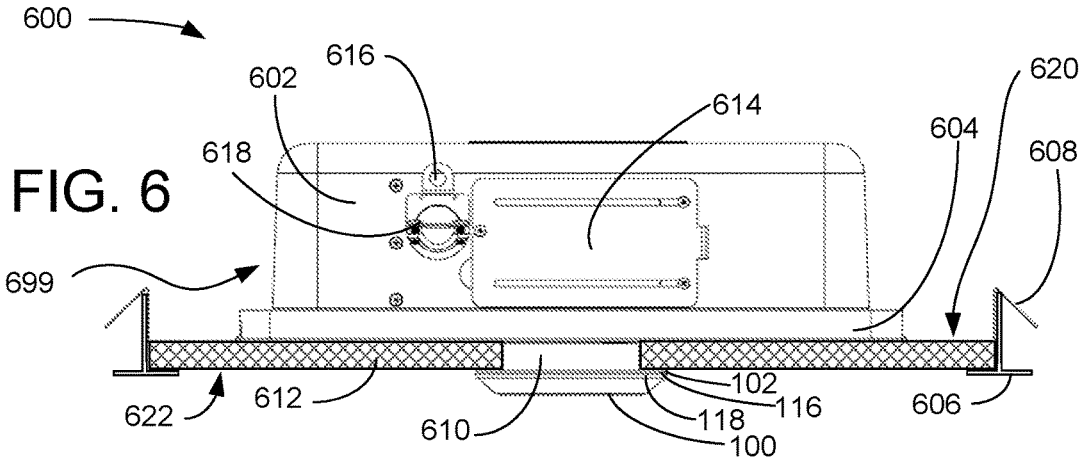
FIG. 6 is a side elevation view illustrating the exemplary embodiment of the cover of FIG. 1 installed in a direct fire speaker system of U.S. patent application Ser. No. 16/129,175 to form the cleanroom small ceiling speaker system, according to a preferred embodiment of the present invention.
Figure 8:
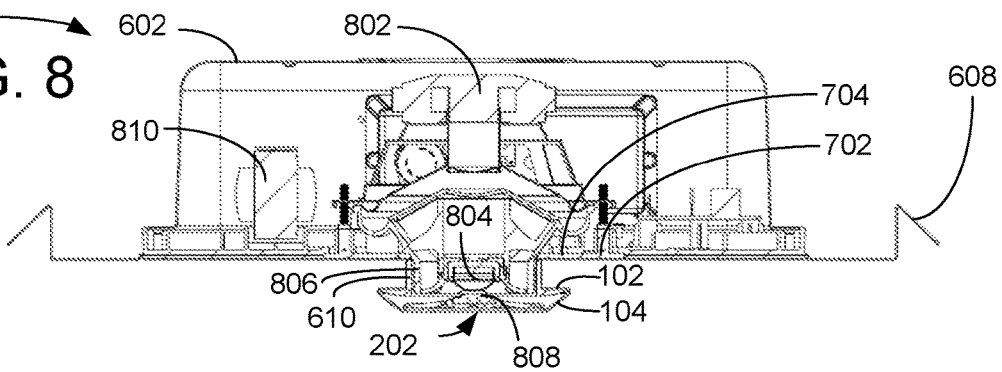
FIG. 8 is a cross-sectional view through cross section BB illustrating the exemplary embodiment of the cleanroom small ceiling speaker system of FIG. 6, according to a preferred embodiment of the present invention.

As used and defined herein, "top", "bottom", "upper", "lower", "upward", and "downward" are referenced to the present invention in its installed orientation, as illustrated in FIG. 6 and in FIG. 8. As used and defined herein, "speaker" means "loudspeaker" or "tweeter", as shown in FIG. 8. As used and defined herein, "cover", without more, means a elastomeric cover having only slight resistance for conducting sound. The claims below contain functional claim language and do not contain any statements of intended use.

The specification and drawings of the Small Ceiling Speaker System of U.S. patent application Ser. No. 15/710,654 is hereby incorporated herein in their entirety. The specification and drawings of the Direct Fire Small Ceiling Speaker System of U.S. patent application Ser. No. 16/129,175 are hereby incorporated herein in their entirety.

Figure 1:
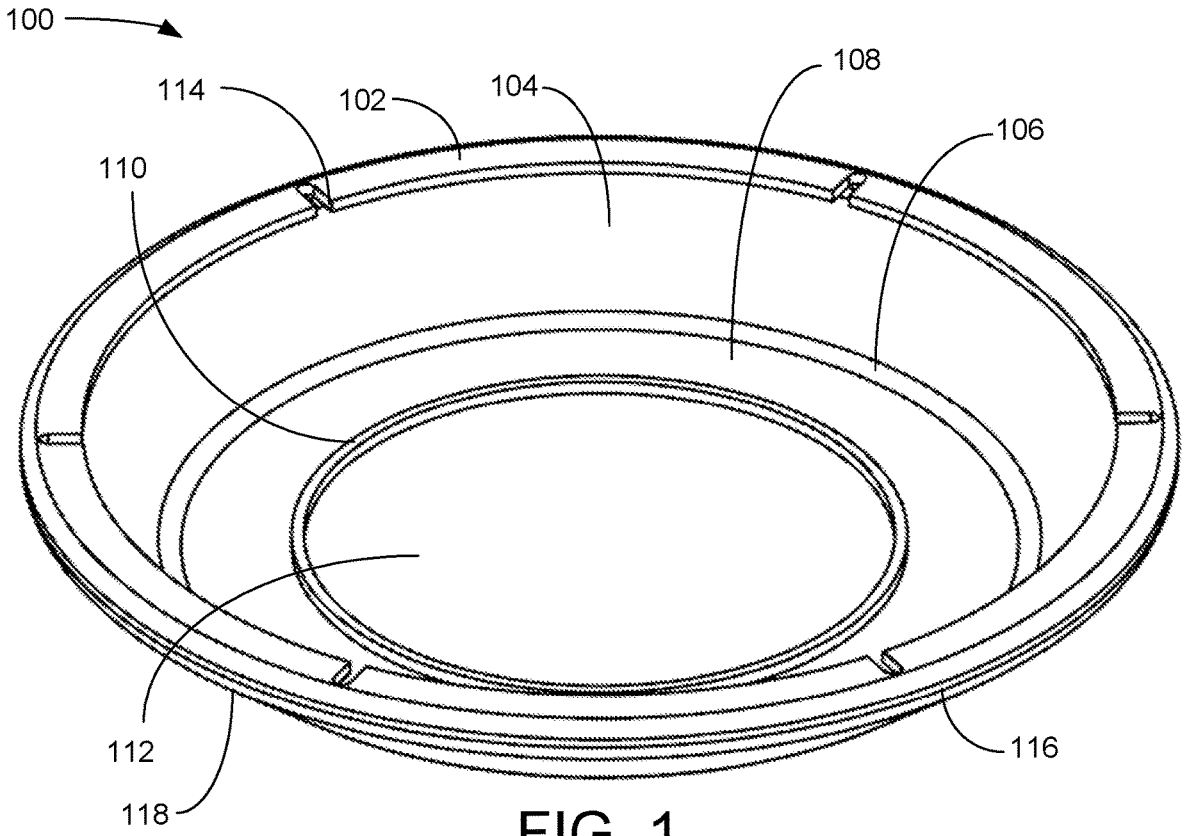
FIG. 1 is a top-bottom perspective exploded view illustrating an exemplary embodiment of the cover for a clean room small ceiling speaker system of FIG. 6, according to a preferred embodiment of the present invention.

FIG. 1 is a top-side perspective view illustrating an exemplary embodiment of the cover 100 for a cleanroom small ceiling speaker system 600 of FIG. 6, according to a preferred embodiment of the present invention. Cover 100 fits over the annular flange 904 (see FIG. 9) of the sound director 1000 (see FIG. 10) of U.S. patent application Ser. No. 16/129,175, or the same annular flange 904 of diffuser 1200 (see FIG. 12), as will be discussed further below. Cover 100 is made of an elastomeric material, is thin enough to allow good sound transmission through the elastomeric material, and is made of a material compatible with cleanroom operations.

Cover 100 is preferably of one piece and includes an axial acoustic transmission panel 112, an internal ridge 110 around the perimeter of the axial acoustic transmission panel 112, an annular panel 108 extending from the ridge 110, and a lower conic section wall 106 extending from the annular panel 108. Upper conic section wall 104 is a radial acoustic transmission panel 104 and extends radially and upwardly from lower conic section wall 106 to first reinforcement ring 118. Second reinforcement ring 116 extends upwardly from first reinforcement ring 118 to upwardly and radially inward rim 102. Rim 102 has notches 114 (one of six labeled) for ease of assembly. In other embodiments, notches 114 may be smaller in length. In a particular embodiment, ridge 110 may be omitted. In that or another particular embodiment, lower conic section wall 106 may be omitted and axial acoustic transmission panel 112 may extend directly into annular panel 108. In those or yet another particular embodiment, first reinforcement ring 118 and/or second reinforcement ring 116 may be omitted, and the upper conic section wall 104 may extend directly into rim 102.

Figure 2:
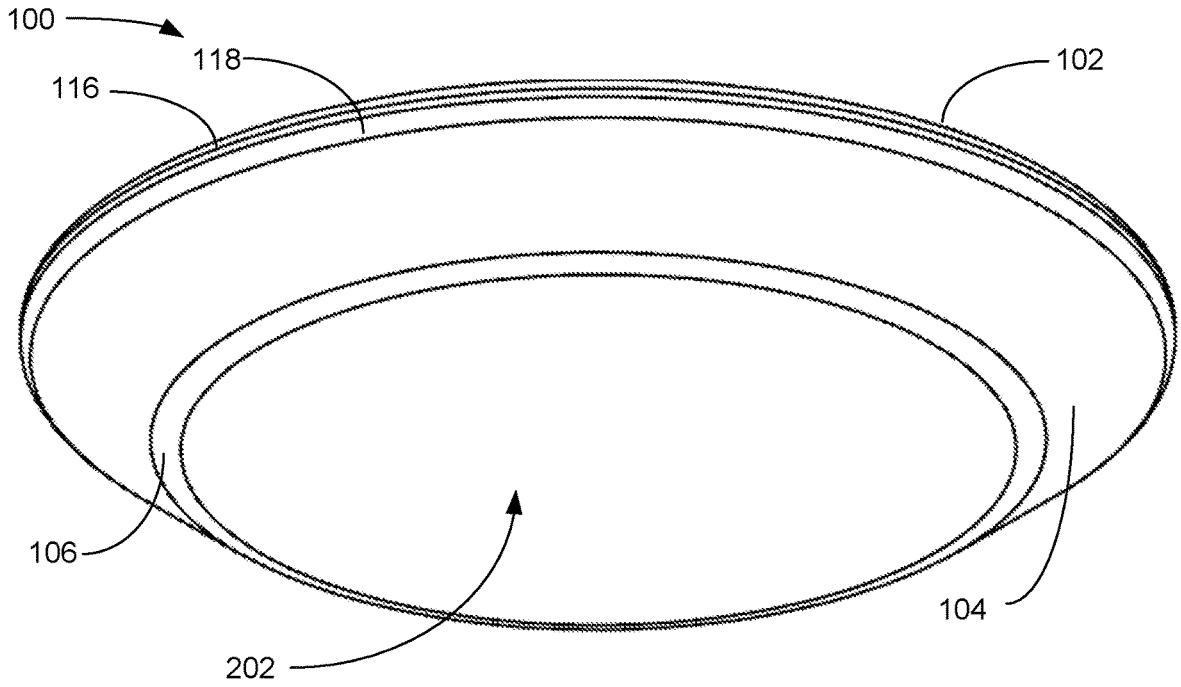
FIG. 2 is a bottom-side perspective view illustrating the exemplary embodiment of the cover of FIG. 1 of the cleanroom small ceiling speaker system of FIG. 6, according to a preferred embodiment of the present invention.

FIG. 2 is a bottom-side perspective view illustrating the exemplary embodiment of the cover 100 of FIG. 1 of the cleanroom small ceiling speaker system 600 of FIG. 6, according to a preferred embodiment of the present invention. The exterior surface 202 of the axial acoustic transmission panel 112, ridge 110, and annular panel 108 is one surface and is preferably flat. The axial acoustic transmission panel 112 is present but not used acoustically when cover 100 is used with diffuser 1200 (see FIG. 12). The radial acoustic transmission panel 104 is present but not used acoustically when cover 100 is used with director 1000 (see FIG. 10).

Figure 3:
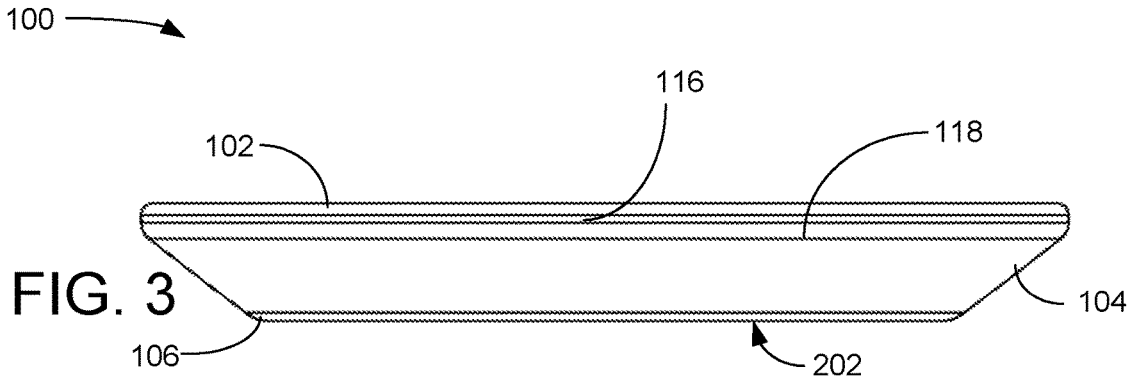
FIG. 3 is a side elevation view illustrating the exemplary embodiment of the cover of FIG. 1 of the cleanroom small ceiling speaker system of FIG. 6, according to a preferred embodiment of the present invention.

FIG. 3 is a side elevation view illustrating the exemplary embodiment of the cover 100 of FIG. 1 of the cleanroom small ceiling speaker system 600 of FIG. 6, according to a preferred embodiment of the present invention. This view is provided for comparison with FIG. 5 and for enablement. Applicant regards the shape of cover 100 to be novel.

Figure 4:
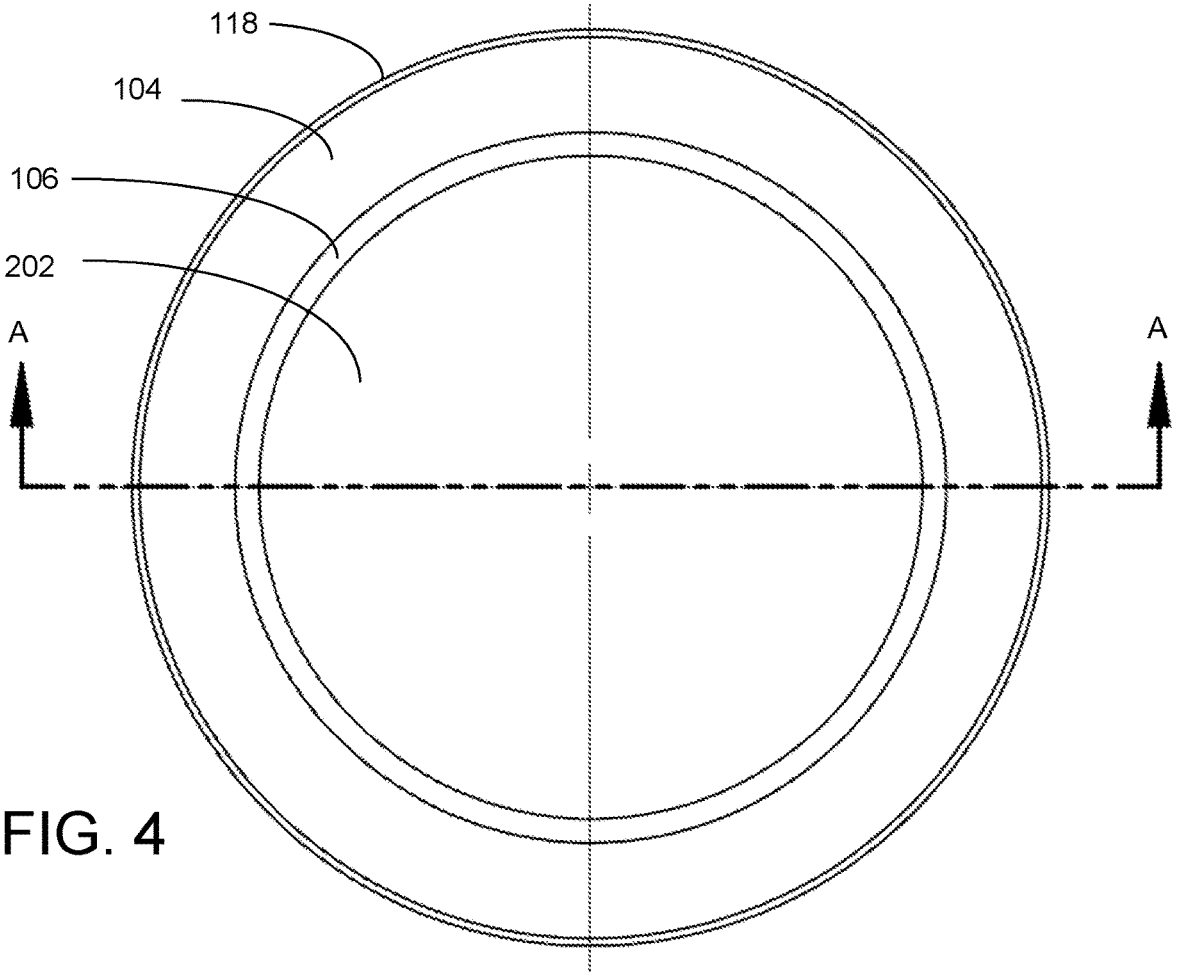
FIG. 4 is a bottom plan view illustrating the exemplary embodiment of the cover of FIG. 1 of the cleanroom small ceiling speaker system of FIG. 6 and defining cross section AA, according to a preferred embodiment of the present invention.

FIG. 4 is a bottom plan view illustrating the exemplary embodiment of the cover 100 of FIG. 1 of the cleanroom small ceiling speaker system 600 of FIG. 6 and defining cross section AA, according to a preferred embodiment of the present invention. This view establishes the cross-section AA. The size of cover 100 is adapted to the acoustic attachment 924 (see FIG. 9), 1000 (see FIG. 10), or 1200 (see FIG. 12).

Figure 5:
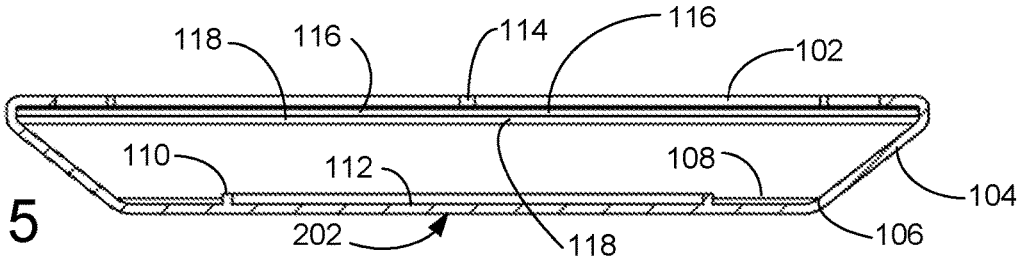
FIG. 5 is a side cross sectional view through cross section AA illustrating the exemplary embodiment of the cover of FIG. 1 of the cleanroom small ceiling speaker system of FIG. 6, according to a preferred embodiment of the present invention.

FIG. 5 is a side cross sectional view through cross section AA illustrating the exemplary embodiment of the cover 100 of FIG. 1 of the cleanroom small ceiling speaker system 600 of FIG. 6, according to a preferred embodiment of the present invention. Ridge 110 will fit over an outer circumferential edge of direct fire ring 808 (see FIG. 8) or grill 1008 (see FIG. 10) when used with a Direct Fire Small Ceiling Speaker System 699 (see FIG. 6) or will fit over an outer circumferential edge 1208 of a diffuser 1200 (see FIG. 12), when used with a Small Ceiling Speaker System. Axial acoustic transmission panel 112, within ridge 110, is the thinnest portion of the bottom of cover 100 and is aligned to the axial acoustic port 922 of an acoustic attachment (director) 924 or 1000. Annular panel 108 reinforces the portion of the bottom of cover 100 that covers an inner annular portion 920 (see FIG. 9) of direct fire ring 808. First reinforcement ring 118 and second reinforcement ring 116 reinforce the portion of cover 100 that contacts the slightly rounded edge 1014 (see FIG. 10) of annular flange 904 (see FIG. 9), when installed. Upper conic section wall 104 is a radial acoustic transmission panel 104 and covers the radial acoustic port 1204 (see FIG. 12) of a diffuser 1200 and is preferably slightly stretched to maintain its shape of a frustum of a conical shell.

FIG. 6 is a side elevation view illustrating the exemplary embodiment of the cover 100 of FIG. 1 installed in a Direct Fire Small Ceiling Speaker System 699 of U.S. patent application Ser. No. 16/129,175 to form the cleanroom small ceiling speaker system 600, according to a preferred embodiment of the present invention. Cleanroom small ceiling speaker system 600 includes enclosure 602, releasably attachable rim 604, and independently extendable braces 608 (one of two visible labeled). Independently extendable braces 608 rest on ceiling tile grid supports 606 (one of two visible labeled). Acoustic channel interface 610 is adjustably slid and then threaded onto an acoustic channel shell 806 (see FIG. 8) of the cleanroom small ceiling speaker system 600 to urge radially inward rim 102 against the bottom surface 622 of ceiling tile 612 to form a cleanroom seal. Enclosure 602 has a bottom panel 706 (see FIG. 7) that is supported, when installed, proximate the top surface 620 of ceiling tile 612.

Enclosure 602 has an access panel 614, a strain relief fixture 616, and audio electrical connectors 618. Enclosure 602 is preferably made of metal and more preferably of aluminum. In various other embodiments, various respective materials may be used. For example, some plastics or stainless steels may be suitable.

Figure 7:
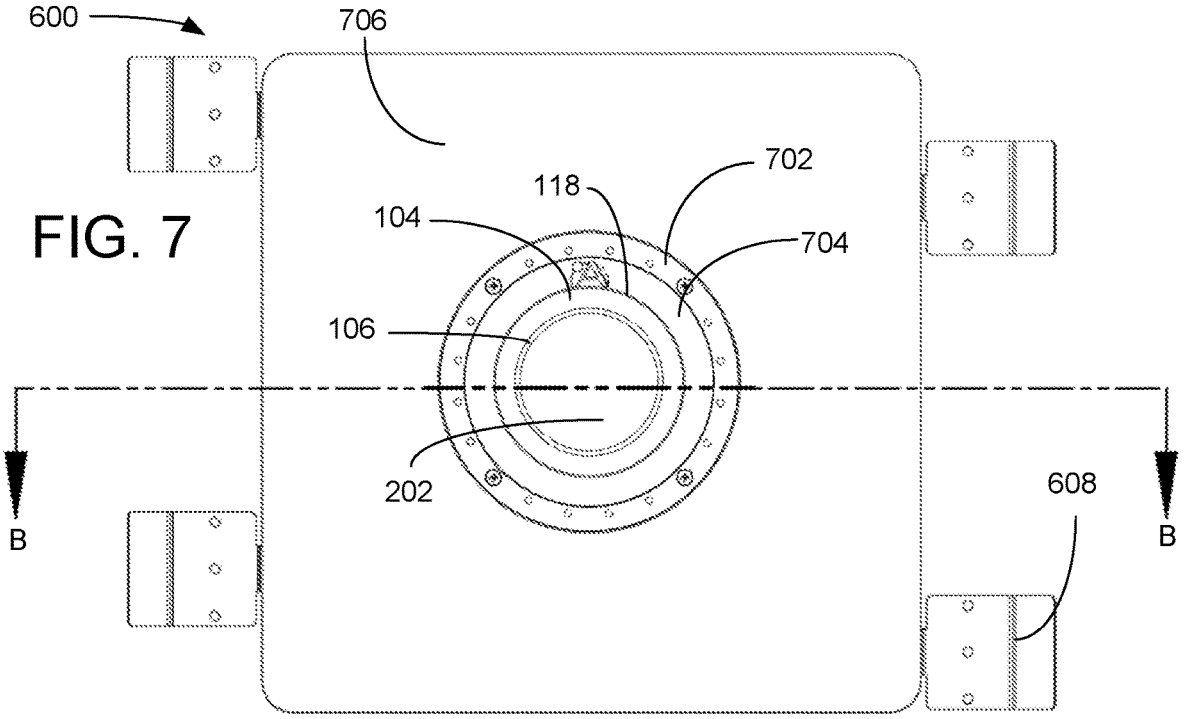
FIG. 7 is a bottom perspective view illustrating the exemplary embodiment of the cleanroom small ceiling speaker system of FIG. 6, according to a preferred embodiment of the present invention.

FIG. 7 is a bottom perspective view illustrating the exemplary embodiment of the cleanroom small ceiling speaker system 600 of FIG. 6 and defining cross section BB, according to a preferred embodiment of the present invention. Bottom panel 706 is internally attached to releasably attachable rim 604 and has a carrier 704 for supporting internal speakers 802 and 804 (see FIG. 8). Carrier is attached to bottom panel 706 via fastener ring 702. Four independently extendable braces 608 (one of four labeled) may extend outwardly to engage various configurations of ceiling tile grid supports 606.

FIG. 8 is a cross-sectional view through cross section BB illustrating the exemplary embodiment of the cleanroom small ceiling speaker system 600 of FIG. 6, according to a preferred embodiment of the present invention. Sound from speaker 802 is downwardly directed through acoustic channel shell 806 and sound from tweeter 804 is directed downwardly through direct fire ring 808. Associated electronics, such as transformer 810, are also housed within enclosure 602.

Figure 9:
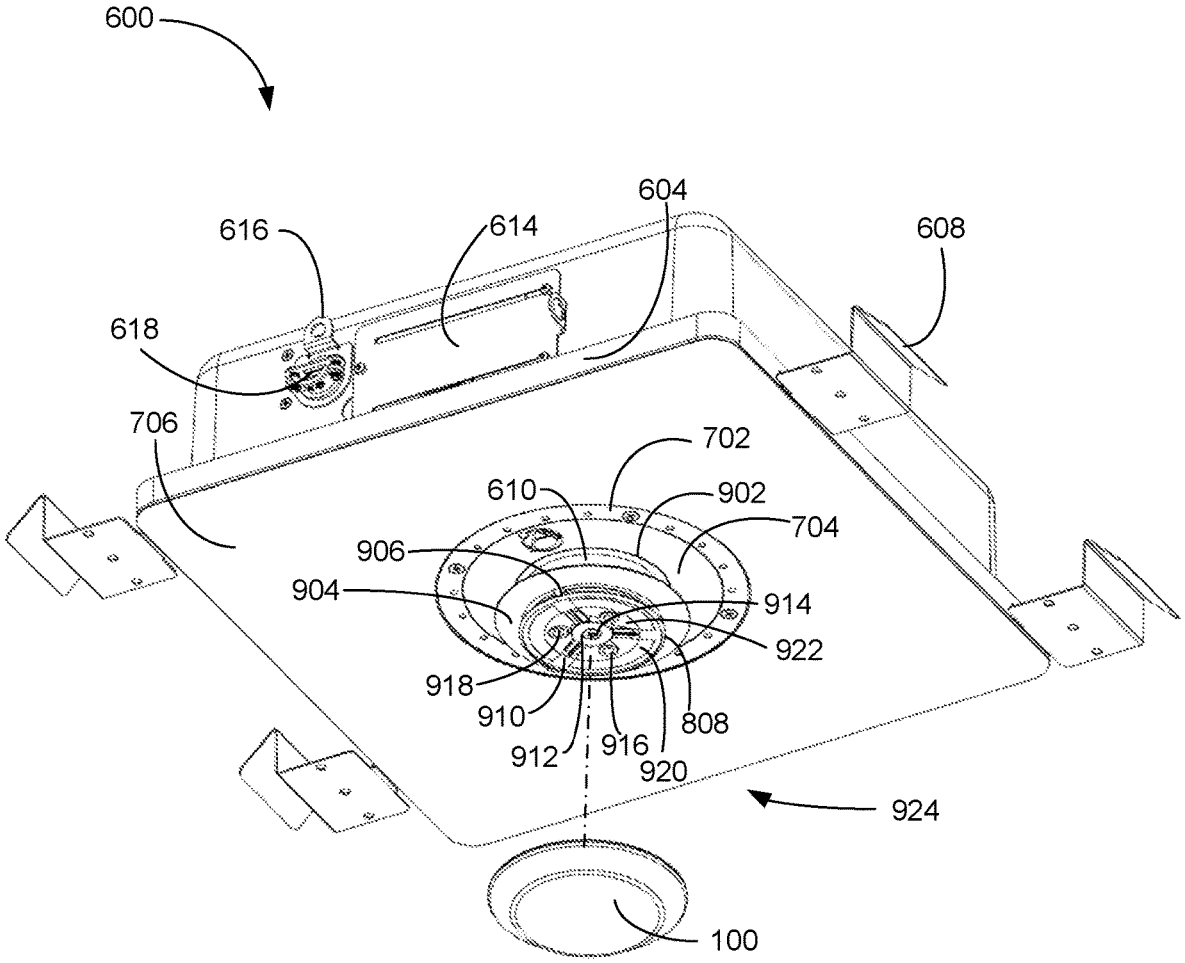
FIG. 9 is an exploded bottom perspective view illustrating the exemplary embodiment of the cleanroom small ceiling speaker system of FIG. 6, according to a preferred embodiment of the present invention.

FIG. 9 is an exploded bottom perspective view illustrating the exemplary embodiment of the cleanroom small ceiling speaker system 600 of FIG. 6, according to a preferred embodiment of the present invention. Carrier 704 has a hole 902 through which acoustic channel shell 806 extends. Acoustic channel interface 610 has two ninety-degree wide opposed sets of internal sectional threads and acoustic channel shell 806 has two ninety-degree wide opposed sets of corresponding external sectional threads, such that the director 1000 (see FIG. 10) can be slid onto the acoustic channel shell 806 and, when engagement of the annular flange 904 with the ceiling tile 612 or radially inward rim 102 is achieved, twisted to engage threads to tighten the director 1000 in place. The director 1000 has spokes 906 (one visible of three labeled) which align to, and partially nest in, spokes 910 (one of three labeled) of direct fire ring 808. Direct fire ring 808 has a hub 912 that partially nests a hub (not visible) of the director interface and fastens to the director interface via fastener 914. Direct fire ring 808 has an inner annular portion 920 that defines the limits of the axial acoustic port 922 which, in turn, aligns to ridge 110 on cover 100, when installed. Annular panel 108 covers inner annular portion 920 when cover 100 is installed. Hub 912 supports magnet cups 916 (one of three labeled) which, in some embodiments, may retain magnets 918 (one of three labeled). The magnets 918 normally retain a speaker grill 1008 (see FIG. 10), which is optionally used in the cleanroom small ceiling speaker system 600.

Figure 10:
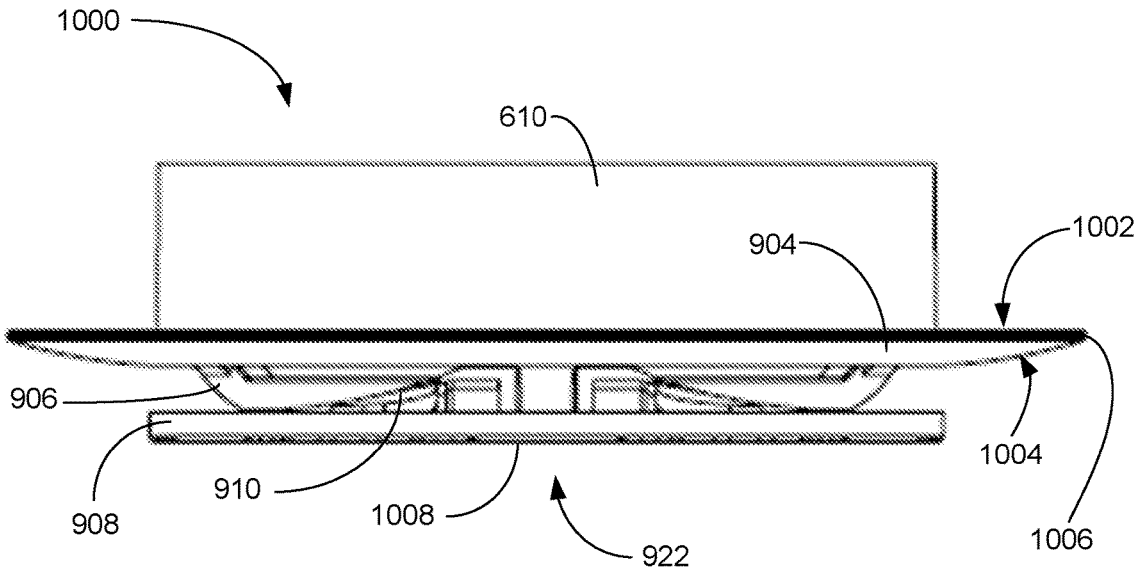
FIG. 10 is a side elevation view illustrating the exemplary embodiment of the director of U.S. patent application Ser. No. 16/129,175, according to a preferred embodiment of the present invention.

FIG. 10 is a side elevation view illustrating the exemplary embodiment of the director 1000 of U.S. patent application Ser. No. 16/129,175 (labeled 100 therein), according to a preferred embodiment of the present invention. Annular flange 904 has a smooth slightly rounded end 1006 to avoid cutting into the vibrating cover 100 during operation. Annular flange 904 has a flat upper surface 1002 and a radially arcuate lower surface 1004. The director 1000 is shown with a grill 1008.

Figure 11:
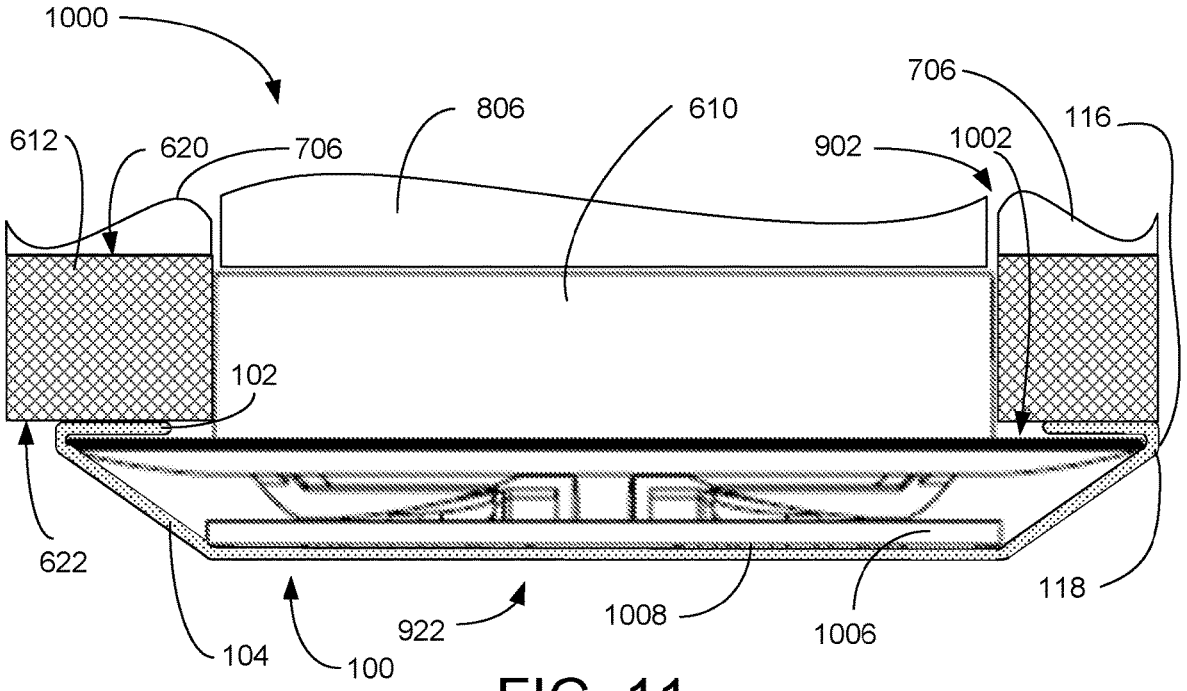
FIG. 11 is a side elevation cross sectional view illustrating the exemplary embodiment of the director of U.S. patent application Ser. No. 16/129,175 with diagrammatic representations of the cover of FIG. 1 and a ceiling tile, according to a preferred embodiment of the present invention.

FIG. 11 is a side elevation cross sectional view illustrating the exemplary embodiment of the director 1000 of U.S. patent application Ser. No. 16/129,175 with diagrammatic representations of the cover 100 of FIG. 1 and a ceiling tile 612 according to a preferred embodiment of the present invention. Ridge 110 and annular panel 108 are not shown for simplicity of the drawing. Radially inward rim 102 is clamped between the bottom surface 622 of ceiling tile 612 and the flat upper surface 1002 of annular flange 904, creating a seal to avoid any contaminant leakage through hole 902. The top surface 620 of ceiling tile 612 is closely proximate, but does not rest upon, the bottom panel 706 of enclosure 602. The acoustic channel interface 610 is slid and then threaded onto the acoustic channel shell 806. In a particular embodiment for use with directors with grills 1008, ridge 110 and annular panel 108 may be omitted.

Figure 12:
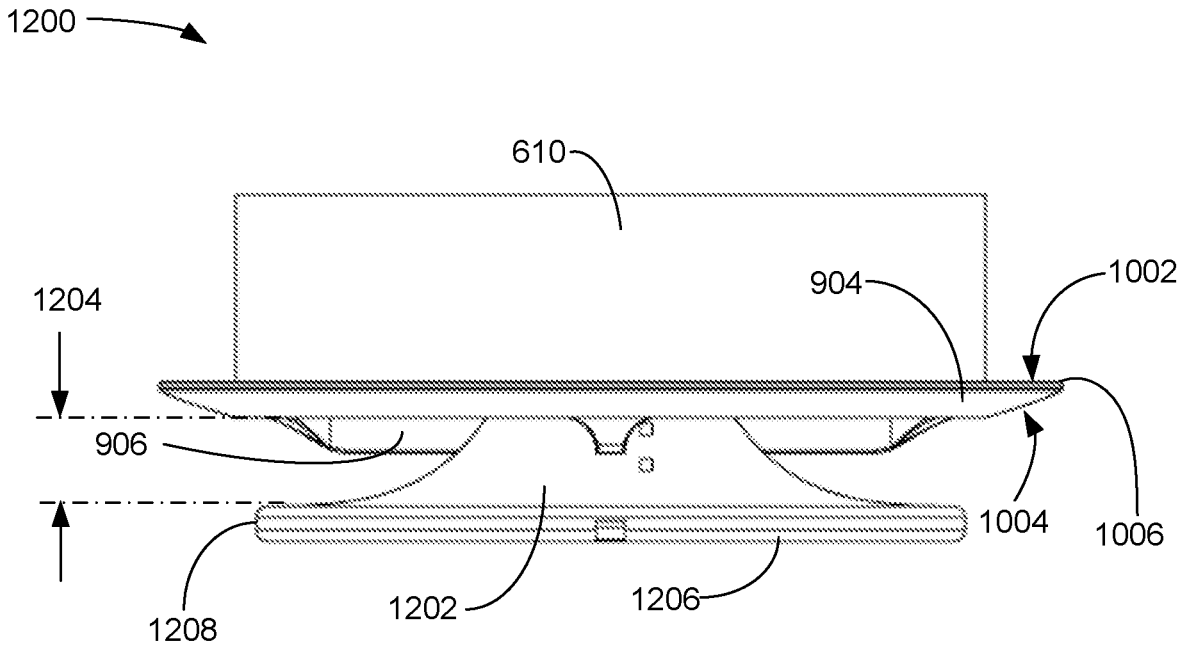
FIG. 12 is a side elevation view of an exemplary embodiment of a diffuser of U.S. patent application Ser. No. 15/710,654 adjusted to a first acoustic port size, according to a preferred embodiment of the present invention.

FIG. 12 is a side elevation view of an exemplary embodiment of a diffuser 1200 of U.S. patent application Ser. No. 15/710,654 adjusted to a first size of a radial acoustic port 1204, according to a preferred embodiment of the present invention. The diffuser 1200 may use the same acoustic channel interface 610 as director 1000, as shown. The radial acoustic port 1204 is formed by the diffuser element 1202 channeling the downwardly directed projected sound from the acoustic channel shell 806 horizontally (not perfectly so, of course). The diffuser element 1202 includes a radially sloped surface, an outer circumferential edge 1208, and a diffuser rim 1206, within which is a metal plate (not visible in this view).

Figure 13:
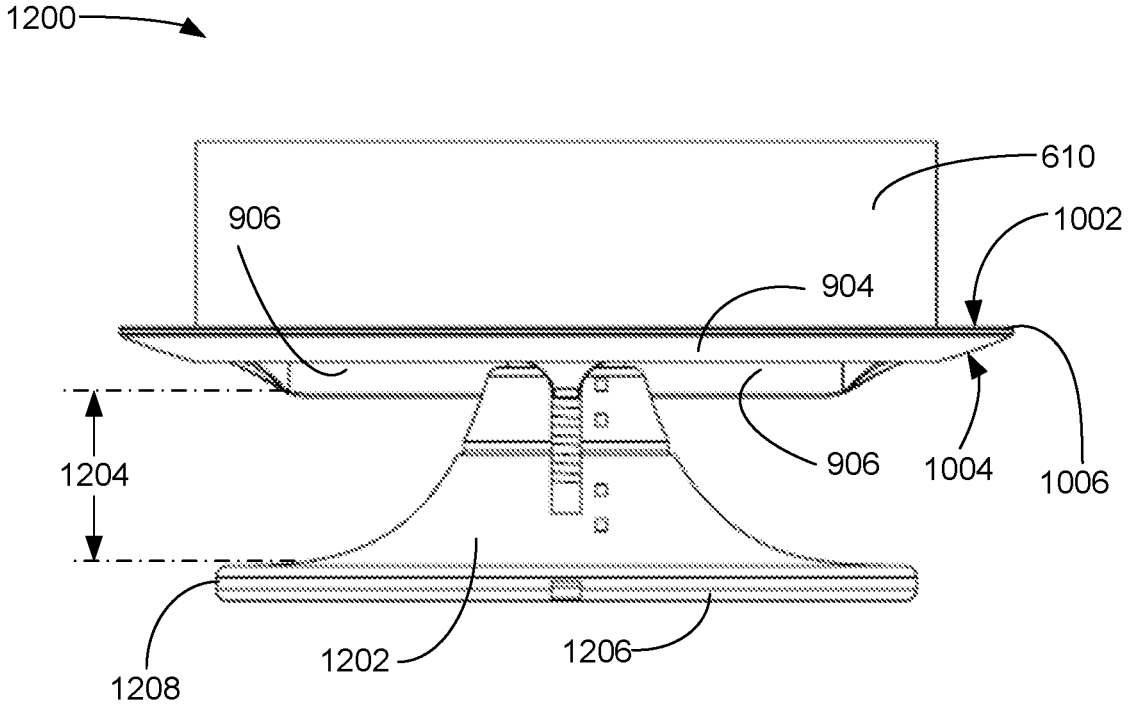
FIG. 13 is a side elevation view of an exemplary embodiment of a diffuser of U.S. patent application Ser. No. 15/710,654 adjusted to a second acoustic port size, according to a preferred embodiment of the present invention.

FIG. 13 is a side elevation view of an exemplary embodiment of the diffuser of FIG. 12 adjusted to a second size of the radial acoustic port 1204, according to a preferred embodiment of the present invention. Elastomeric cover 100 preferably has sufficient elasticity to function at either a first or a second sized radial acoustic port 1204, and any sizes in between.

The claims below contain functional claims and do not include any statements of intended purpose.

I claim:

1. A cleanroom small ceiling speaker system comprising:
- a. an elastomeric cover operable to cover:
  - i. a portion of an annular flange of one of:
    - 1. a director; and
    - 2. a diffuser;
  - ii. an axial acoustic port of said director; and
  - iii. a radial acoustic port of said diffuser; and
- b. a seal against contamination entering a cleanroom from said cleanroom small ceiling speaker system.

2. The system of claim 1, wherein said elastomeric cover comprises:
- a. an acoustic transmission panel;
- b. an annular panel extending radially outward from said acoustic transmission panel;
- c. an upper conic section wall extending radially outward and axially upward from proximate said annular panel;
- d. a radially inward rim extending above and radially inward from proximate said upper conic section wall; and
- e. one piece of elastomer.

3. The system of claim 2, comprising:
- a. an annular ridge extending:
  - i. upward from a perimeter of said acoustic transmission panel; and
  - ii. around said perimeter of said acoustic transmission panel;
- b. a lower conic section wall extending radially outward and axially upward from said annular panel to said upper conic section wall;
- c. a first reinforcement ring extending axially upward from said upper conic section wall; and
- d. a second reinforcement ring extending axially upward from said first reinforcement ring.

4. The system of claim 2, comprising:
- a. an enclosed small ceiling speaker system operable to project sound through a partially threaded acoustic channel shell; and
- b. an acoustic attachment, comprising one of a director and a diffuser, adjustably and threadedly engageable to said partially threaded acoustic channel shell and operable, when so engaged, to respectively direct said projected sound downward and diffuse said projected sound radially;

c. wherein said acoustic attachment comprises an annular flange extending radially outward from a cylindrical shell of said acoustic attachment and further comprising:
   i. a flat upper surface;
   ii. a radially arcuate lower surface; and
   iii. a rounded radially outward edge between said upper surface and said lower surface.

5. The system of claim 4, wherein said radially inward rim of said cover is configured to cover a portion of said flat upper surface of said annular flange, and to extend radially inward from said rounded radially outward edge of said annular flange.

6. The system of claim 5, wherein said first and second reinforcement rings are configured to extend around said outer edge of said annular flange.

7. The system of claim 5, wherein said upper conic section wall is configured to cover a space between said outer edge of said annular flange and a lowest outer edge said acoustic attachment.

8. The system of claim 7, wherein said lower conic section wall is configured to engage said outer edge of said acoustic attachment.

9. The system of claim 7, wherein said annular panel is configured to engage an inner annular bottom surface portion of said acoustic attachment.

10. The system of claim 7, wherein said ridge is configured to align to a perimeter of said axial acoustic port of said director.

11. The system of claim 7, wherein said acoustic transmission panel aligns with said acoustic port of said director.

12. A cleanroom small ceiling speaker system comprising:

a. a one-piece elastomeric cover operable to cover:
   i. a portion of an annular flange of an acoustic attachment; and
   ii. an acoustic port of said attachment comprising one of:
      1. a radial acoustic port; and
      2. an axial acoustic port; and b. wherein said elastomeric cover comprises:
   i. an axial acoustic transmission panel;
   ii. an annular panel extending radially outward from said acoustic transmission panel;
   iii. a radial acoustic transmission panel further comprising an upper conic section wall extending radially outward and axially upward from proximate said annular panel; and
   iv. a radially inward rim extending above and radially inward from proximate said upper conic section wall.

13. The system of claim 12, comprising an acoustic attachment further comprising:

a. a director having an axial acoustic port and operable, when installed, to direct said projected sound axially downward; and b. a diffuser having a radial acoustic port and operable, when installed, to diffuse said projected sound radially.

14. The system of claim 12, wherein said annular flange comprises an annular flange extending radially outward from a cylindrical shell of said acoustic attachment and further comprising:

a. a flat upper surface;

b. a radially arcuate lower surface; and c. a rounded outer edge between said upper surface and said lower surface.

15. The system of claim 14, wherein said radially inward rim of said cover is configured to cover a portion of said flat upper surface of said annular flange via extending upward and radially inward from proximate said upper conic wall.

16. The system of claim 14, wherein:

a. a ridge extending:
   i. upward from a perimeter of said acoustic transmission panel; and
   ii. extending around said perimeter of said acoustic transmission panel;

b. a lower conic section wall extending radially outward and axially upward from said annular panel to said upper conic section wall;

c. a first reinforcement ring extending axially upward from said upper conic section wall;

d. a second reinforcement ring extending axially upward from said first reinforcement ring;

e. said first and second reinforcement rings are configured to extend around said rounded outer edge of said annular flange; and f. said upper conic section wall is configured to cover one of:
   i. said radial acoustic port; and
   ii. a gap between said annular flange and one of:
      1. a direct fire ring of said director; and
      2. a grill installed on said direct fire ring.

17. The system of claim 16, comprising:

a. an enclosed small ceiling speaker system operable to project sound through a sectionally threaded acoustic channel shell; and b. said acoustic attachment having corresponding sectional threads and configured to be adjustably and threadedly engageable to said sectionally threaded acoustic channel shell;

c. wherein said lower conic section wall is configured to engage said outer edge of one of:
   i. said direct fire ring of said acoustic attachment; and
   ii. a diffuser element of said acoustic attachment;

d. wherein said annular panel is configured to engage an inner annular portion of one of:
   i. said direct fire ring of said acoustic attachment; and
   ii. a diffuser element of said acoustic attachment;

e. said ridge is configured to align to a perimeter of said axial acoustic port; and f. said acoustic transmission panel is configured to align with said axial acoustic port.

18. A cleanroom small ceiling speaker system comprising:

a. an enclosed small ceiling speaker system operable to project sound through a sectionally threaded acoustic channel shell; and b. an acoustic attachment having corresponding sectional threads and configured to be adjustably and threadedly engageable to said sectionally threaded acoustic channel shell;

c. a one-piece elastomeric cover operable to cover:
   i. a portion of an annular flange of said acoustic attachment; and
   ii. an acoustic port of said attachment comprising one of:
      1. a radial acoustic port; and
      2. an axial acoustic port;

d. wherein said elastomeric cover comprises:
   i. an axial acoustic transmission panel;
   ii. an annular panel extending radially outward from said acoustic transmission panel;

iii. a radial acoustic transmission panel further comprising an upper conic section wall extending radially outward and axially upward from proximate said annular panel;

iv. a radially inward rim extending above and radially inward from proximate said upper conic section wall, wherein said radially inward rim of said cover is configured to cover a portion of a flat upper surface of said annular flange; and e. wherein said acoustic attachment is one of:

i. a director having said axial acoustic port and configured to direct said projected sound axially downward; and ii. a diffuser having said radial acoustic port and configured to diffuse said projected sound radially.

19. The system of claim 18, wherein:

a. a ridge extending:

i. upward from a perimeter of said acoustic transmission panel; and ii. around said perimeter of said acoustic transmission panel;

b. a lower conic section wall extending radially outward and axially upward from said annular panel to said upper conic section wall;

c. a first reinforcement ring extending axially upward from said upper conic section wall;

d. a second reinforcement ring extending axially upward from said first reinforcement ring;

e. wherein said first and second reinforcement rings are configured to extend around said rounded outer edge of said annular flange;

f. said upper conic section wall is configured to cover one of:

i. said radial acoustic port; and ii. a gap between said annular flange and one of:

1. said direct fire ring; and 2. a grill installed on said direct fire ring; and g. said lower conic section wall is configured to engage said outer edge of one of:

i. a direct fire ring of said acoustic attachment; and ii. a diffuser element of said acoustic attachment.

20. The system of claim 19, wherein:

a. said annular panel is configured to engage an inner annular portion of one of:

i. said direct fire ring of said acoustic attachment; and ii. said diffuser element of said acoustic attachment;

b. said ridge is configured to align to a perimeter of said axial acoustic port; and c. said acoustic transmission panel is configured to align with said axial acoustic port.

* * * * *